US010054289B2

(12) United States Patent
Wen

(10) Patent No.: US 10,054,289 B2
(45) Date of Patent: Aug. 21, 2018

(54) ILLUMINATION DEVICE FOR INFINITE MIRRORING

(71) Applicant: Nzxt Inc., City of Industry, CA (US)

(72) Inventor: Paul Wen, City of Industry, CA (US)

(73) Assignee: NZXT Inc., City of Industry, CA (US)

( * ) Notice: Subject to any disclaimer, the term of this patent is extended or adjusted under 35 U.S.C. 154(b) by 278 days.

(21) Appl. No.: 15/198,317

(22) Filed: Jun. 30, 2016

(65) Prior Publication Data

US 2018/0003360 A1 Jan. 4, 2018

(51) Int. Cl.

| | |
|---|---|
| ***F21V 7/00*** | (2006.01) |
| ***F21V 17/10*** | (2006.01) |
| ***F21K 9/61*** | (2016.01) |
| ***F21V 29/58*** | (2015.01) |
| *F21Y 115/10* | (2016.01) |
| *F21Y 113/10* | (2016.01) |

(52) U.S. Cl.

CPC ..... *F21V 7/0033* (2013.01); *F21K 9/61* (2016.08); *F21V 17/10* (2013.01); *F21V 17/101* (2013.01); *F21V 29/58* (2015.01); *F21Y 2113/10* (2016.08); *F21Y 2115/10* (2016.08)

(58) Field of Classification Search

CPC ..... F21K 9/01; F21V 7/0033; F21V 17/10; F21V 17/101; F21V 29/58; F21Y 2113/10; F21Y 2115/10

See application file for complete search history.

(56) References Cited

U.S. PATENT DOCUMENTS

| | | | | |
|---|---|---|---|---|
| 4,139,955 A * | 2/1979 | Reiback | ..... | G09F 13/12 359/839 |
| 4,922,384 A * | 5/1990 | Torrence | ..... | G02B 6/0005 362/245 |
| 5,810,465 A * | 9/1998 | Hargabus | ..... | G02B 27/024 362/135 |

* cited by examiner

*Primary Examiner* — Stephen F Husar

(74) *Attorney, Agent, or Firm* — Muncy, Geissler, Olds & Lowe, P.C.

(57) ABSTRACT

An illumination device for infinite mirroring, has a lighting module. A light-guiding frame guides a first light source of the lighting module to form light-guiding light source. The lower mirror reflects the light-guiding light source to form a reflection light source reflecting mirror images. The light-guiding ring has a light-guiding surface. The reflection light source incident on the light-guiding ring uniformly scatters to the light-guiding surface to form a ring-shaped light source. The lower mirror uses a first hollow interruption element to interrupt a part of the reflection light source to form a spaced layered light source. The upper mirror simultaneously reflects the ring-shaped light source and the spaced layered light source and uses the second hollow interruption element in the hollow cover to interrupt the ring-shaped light source to form a multilayered mirroring light ring.

10 Claims, 7 Drawing Sheets

ILLUMINATION DEVICE FOR INFINITE MIRRORING

BACKGROUND OF THE INVENTION

Field of the Invention

The present invention relates to an illumination device, particularly to an illumination device for infinite mirroring creating layered lighting effects.

Description of the Related Art

Nowadays, saving energy and reducing carbon is the most international topic to reduce global warming. Thus, a key target of industry technology is how to save electricity and consumables. Since the technology of light emitting diodes (LEDs) develops and matures and LEDs have advantages of small volumes, long lifetime, low power consumption, low heat loss, high brightness, fast starting speed, abundant color, and having environmental materials to favor mass production and to feature high reliability, LEDs are easily fabricated according to requirement of application. Besides, in recent years, the lighting strength technology has made a breakthrough, so that LEDs have applied to illumination devices and replaced traditional tungsten lamps, fluorescent lamps, and energy efficient light bulbs. As a result, LEDs will be the focus in the future.

LEDs have applied to various lamps whereby people enjoy low power consumption and long lifetime of LEDs in their life. Besides, different products of LED lamps have applied to buildings, houses, offices, or various vehicles such as cars or motorcycles. Alternatively, LEDs have applied to electronic products to create lighting effects. Changing brightness, color, color temperature and winking states of LEDs can improve the effects of hinting, warning and creating atmospheres produced by light of lamps.

Presently, lamps have requirements for shape, illumination and warning and in addition to that lighting aesthetic must be concerned. Thus, the application of art aesthetic of lamps is more concerned in life. On top of that, the unique and gorgeous lighting effect should be produced based on how to use the least LEDs rather than how to simply change brightness, color, color temperature and winking states of LED lamps. As a result, how to make the lighting effects of illumination devices more unique and combine them with various products is the problem to be solved.

To overcome the abovementioned problems, the present invention provides an illumination device for infinite mirroring, so as to solve the afore-mentioned problems of the prior art.

SUMMARY OF THE INVENTION

A primary objective of the present invention is to provide an illumination device for infinite mirroring, which guides light in two stages, and which uses interruption elements to interrupt a part of the light, and which uses upper and lower mirrors to repeatedly reflect the light back and forth, thereby producing the unique and dazzle lighting effect for infinite mirroring with gradient and endlessly-changing depth.

To achieve the abovementioned objectives, the present invention provides an illumination device for infinite mirroring, which comprises a bottom base, a light-guiding frame, a lower mirror, a light-guiding ring, a hollow cover, and an upper mirror. The bottom base is provided with a lighting module. The lighting module has a plurality of first lighting elements spaced, and the first lighting elements generate a first light source. The light-guiding frame is arranged on the bottom base, and a lower end of the light-guiding frame has a plurality of light-guiding portions corresponding to the first lighting elements. Each light-guiding portion has a light-received surface. The light-guiding portions guide the first light source of the first lighting elements to pass through light-guiding scatter paths of the light-received surface, thereby forming a light-guiding light source, and this is the process that the light is guided for the first time. The lower mirror is arranged on the light-guiding frame and reflects the light-guiding light source to form a reflection light source reflecting mirror images. The light-guiding ring is arranged on the lower mirror and has a light-guiding surface, and a lower end of the light-guiding ring has a first hollow interruption element. The reflection light source incident on the light-guiding ring uniformly scatters to the light-guiding surface to form a ring-shaped light source. The lower mirror uses the first hollow interruption element to interrupt a part of the reflection light source to form a spaced layered light source, which produces the layered light source effect in the first stage. The hollow cover is arranged on the bottom base and provided with a second hollow interruption element therein whereby the light-guiding frame, the lower mirror and the light-guiding ring are arranged between the bottom base and the hollow cover. The upper mirror is arranged on the hollow cover and simultaneously reflects the ring-shaped light source and the spaced layered light source, and the second hollow interruption element interrupts the ring-shaped light source to form a multilayered mirroring light ring. Meanwhile, the upper mirror reflects the light once again to produce the more layered light source effect. As a result, two light-guiding processes cooperate with the upper and lower mirrors repeatedly reflecting the light to achieve the lighting effect for infinite mirroring with gradient and endlessly-changing depth.

Below, the embodiments are described in detail in cooperation with the drawings to make easily understood the technical contents, characteristics and accomplishments of the present invention.

DETAILED DESCRIPTION OF THE INVENTION

Nowadays, the lighting effect of illumination devices is adjusted according to lighting modes of lighting elements. Alternatively, the lighting effect focuses on light strength or appearance designs of the lighting elements. However, in life of jumping technology, people have more and more requirements for visual beauty. The illumination devices that can attract eyes of customers have to possess practicability and visual beauty. Presently, the unique illumination devices with practicability and visual beauty are not specifically developed and designed by industry, whereby the design concept for lighting effect follows routines without thinking about improvement. As a result, the inventor researches and develops a product with a specific design to improve the drawbacks of existing products for many years. Then, the present invention details how to use a new illumination device for infinite mirroring to achieve the demand for gorgeous light.

Figure 1:
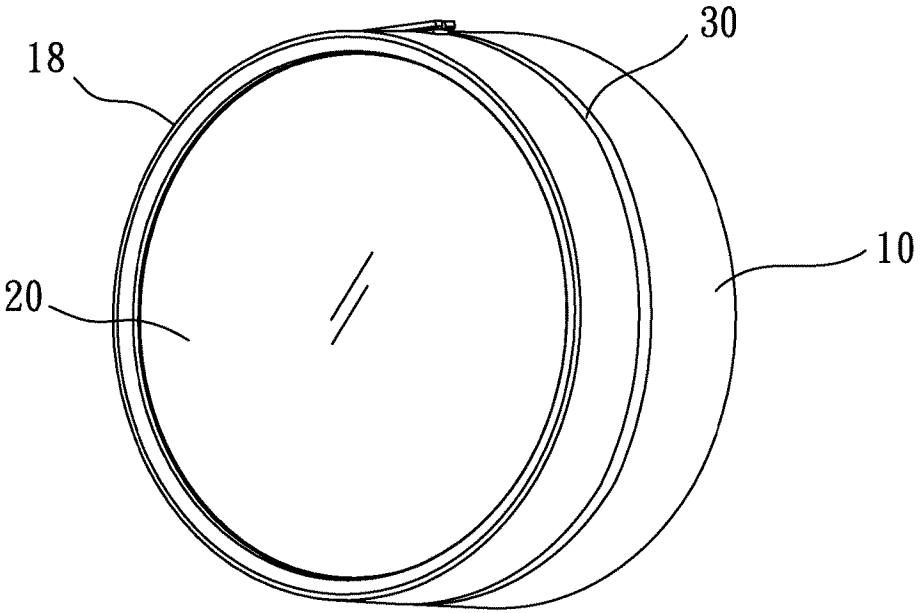
FIG. 1 is a diagram schematically showing an illumination device according to an embodiment of the present invention.
Figure 2:
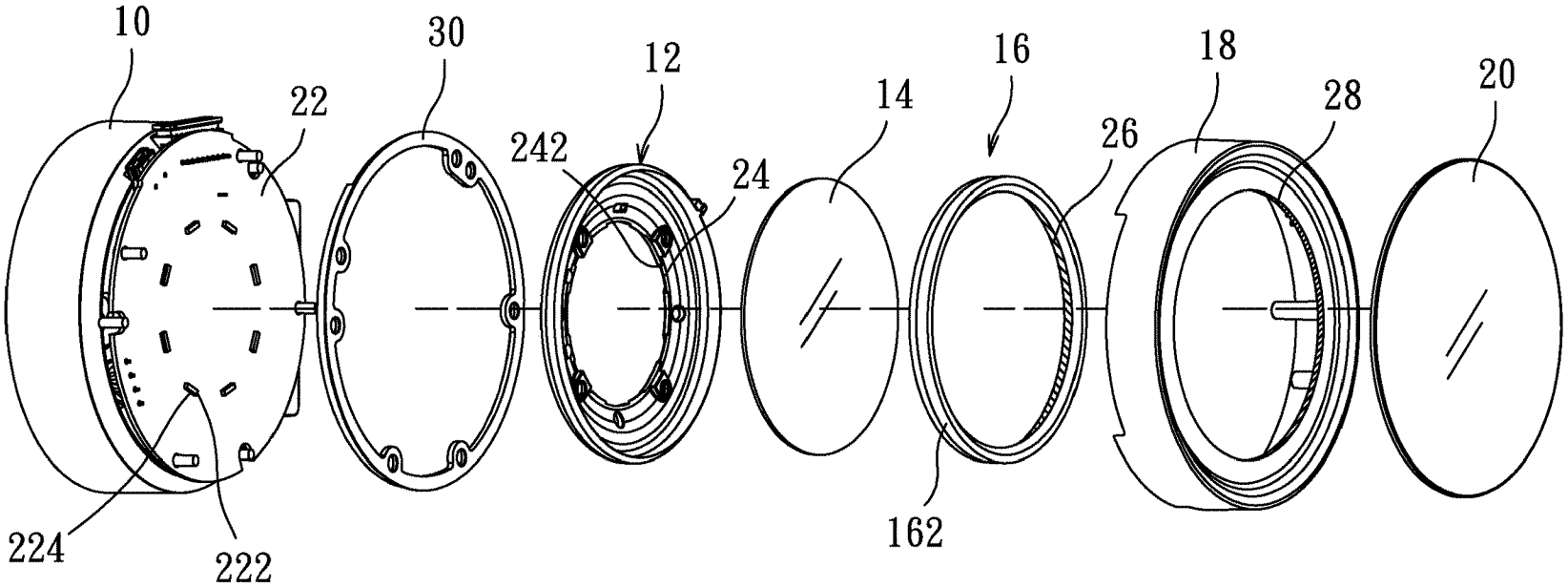
FIG. 2 is an exploded view of FIG. 1.
Figure 3:
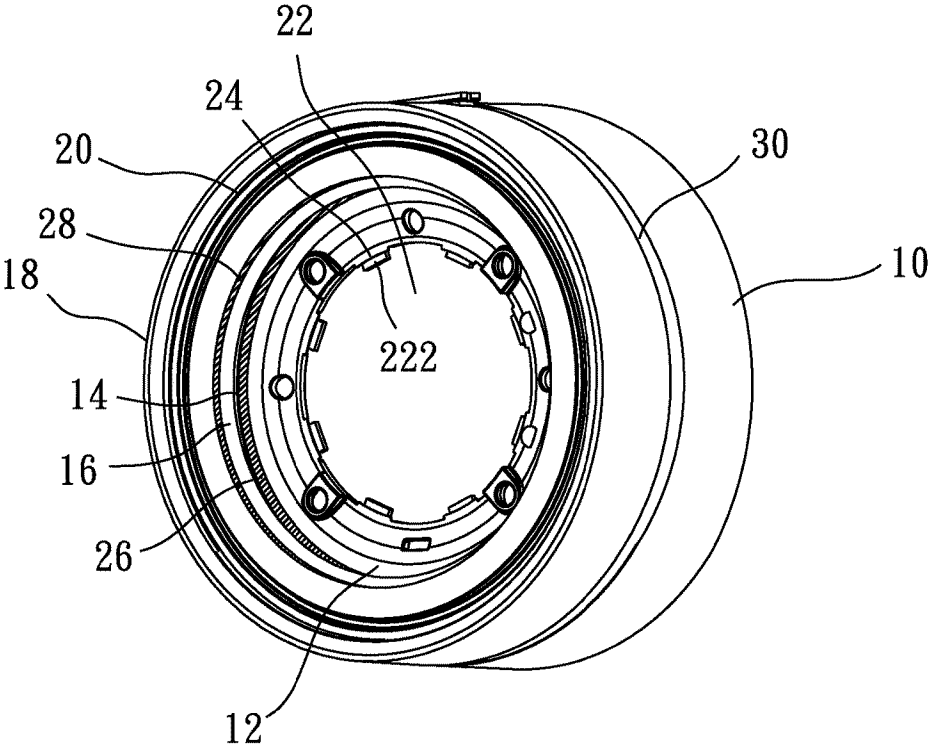
FIG. 3 is a perspective view of FIG. 1.
Figure 4:
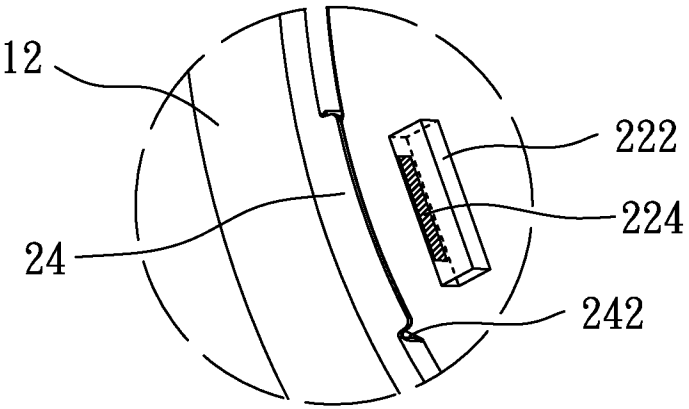
FIG. 4 is diagram schematically showing an enlarged part of an illumination device according to an embodiment of the present invention.

Refer to FIG. 1, FIG. 2 and FIG. 3. FIG. 1 is a diagram schematically showing an illumination device according to an embodiment of the present invention. FIG. 2 is an exploded view of FIG. 1. FIG. 3 is a perspective view of FIG. 1. Firstly, detail the elements and connection relationship thereof of the illumination device of the present invention to realize the new design of the inventor. The illumination device for infinite mirroring comprises a bottom base 10, a light-guiding frame 12, a lower mirror 14, a light-guiding ring 16, a hollow cover 18 and an upper mirror 20. The bottom base 10 is provided with a lighting module 22, and the lighting module 22 has a plurality of first lighting elements 222 spaced, and the first lighting elements 222 generate a first light source. The lighting module 22 has the first lighting elements 222 peripherally spaced, and the first lighting elements 222 are light-emitting diodes (LEDs) for lateral lighting. The light-guiding frame 12 is arranged on the bottom base 10, and an inner side of a lower end of the light-guiding frame 12 has a plurality of light-guiding portions 24 corresponding to the first lighting elements 222. Each light-guiding portion 24 has a light-received surface 242. Refer to FIG. 4. FIG. 4 is diagram schematically showing an enlarged part of the illumination device according to an embodiment of the present invention. Since the first lighting elements 222 are realized with light-emitting diodes for lateral lighting, the light-guiding portions 24 coordinate the design of the first lighting elements 222. Preferably, the light-received surface 242 of the light-guiding portion 24 has a concave portion with a curved surface. A light-emitting surface 224 of each first lighting element 222 is correspondingly attached to the light-received surface 242. When the first lighting elements 222 generate the first light source, the light-guiding portions 24 guide the first light source of the first lighting elements 222 to pass through the light-received surface 242 to form light-guiding scatter paths. In other words, using the concave portion with the curved surface of the light-received surface 242, optical routes of the first light source of each first lighting element 222 pass along the light-guiding scatter paths at two side of the light-received surface 242, whereby the lower end of the light-guiding frame 12 forms a ring-shaped light-guiding light source, and this is the process that the light is guided for the first time.

The lower mirror 14 is arranged on the light-guiding frame 12. Since the light-guiding frame 12 of the present invention is realized with a recessed frame with a depth. The lower mirror 14 reflects the light-guiding light source to form a reflection light source reflecting mirror images. Then, the light-guiding ring 16 is arranged on the lower mirror 14. The light-guiding ring 16 is a semi-transparent sand surface light-guiding ring. The light-guiding ring 16 has a light-guiding surface 162. A lower end of the light-guiding ring 16 has a first hollow interruption element 26 made of opaque material. When the light-received surface 242 of the light-guiding portion 24 receives the first light source, the light-guiding frame 12 guides the light source whereby the reflection light source incident on the light-guiding ring 16 uniformly scatters to the light-guiding surface 162 to form a ring-shaped light source. The light-guiding ring 16 mixes the light for the second time to make the ring-shaped light source more uniform, and this is the process that the light is guided for the second time. Meanwhile, the lower mirror 14 uses the first hollow interruption element 26 to interrupt a part of the reflection light source to form a spaced layered light source, thereby producing the layered light source effect in the first stage.

The hollow cover 18 is arranged on the bottom base 10 and provided with a second hollow interruption element 28 therein whereby the light-guiding frame 12, the lower mirror 14 and the light-guiding ring 16 are arranged between the bottom base 10 and the hollow cover 18. The illumination device further comprises an installation element 30. The hollow cover 18 is fixed on the bottom base 10 through the installation element 30. The upper mirror 20 is arranged on the hollow cover 18. Preferably, the upper mirror 20 is fixed on the hollow cover 18 through an adhesive. The upper mirror 20 simultaneously reflects the ring-shaped light source of the light-guiding ring 16 and the spaced layered light source of the lower mirror 14, and the second hollow interruption element 28 interrupts the ring-shaped light source to form a multilayered mirroring light ring. Meanwhile, the upper mirror 20 reflects the light once again to produce the more layered light source effect. As a result, the present invention uses the first lighting elements 222 to laterally emit the light, and guides the light to pass through the light-guiding scatter paths of the light-guiding portions 24 to form the light-guiding light source, whereby the light-guiding frame 12 is in the state of ring-shaped lighting and then the lower mirror 14 reflects the light-guiding light source to form the reflection light source reflecting mirroring images. Then, the first hollow interruption element 26 of the light-guiding ring 16 interrupts the reflection light source so that the reflection light source incident on the light-guiding ring 16 uniformly scatters to the light-guiding surface to form the ring-shaped light source. Meanwhile, the lower mirror 14 uses the first hollow interruption element 26 to interrupt a part of the reflection light source to form the spaced layered light source. Finally, the upper mirror 20 simultaneously reflects the ring-shaped light source and the spaced layered light source, and uses the second hollow interruption element 28 to interrupt the ring-shaped light source to form the multilayered mirroring light ring. When a user looks at an interior of the illumination device through the upper mirror 20, the illumination device can produce the lighting effect for infinite mirroring with gradient and endlessly-changing depth. Thus, the illumination device possesses the unique design and strong market competitiveness.

Figure 5:
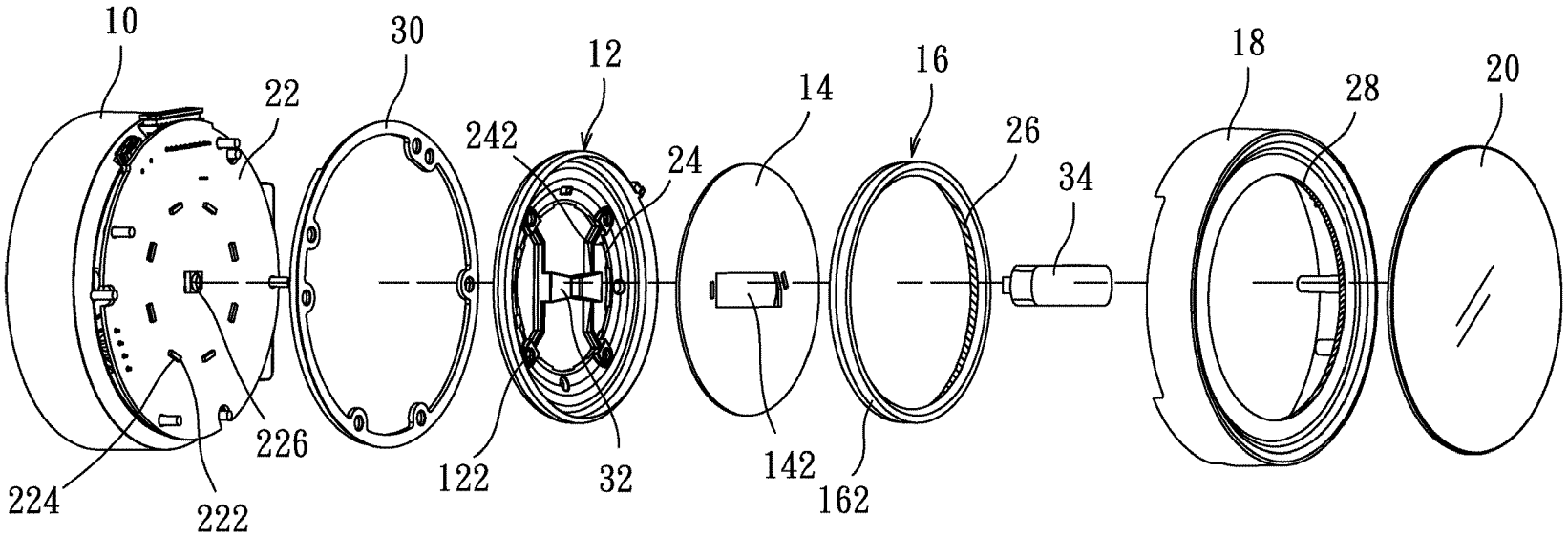
FIG. 5 is an exploded view of an illumination device according to another embodiment of the present invention.
Figure 6:
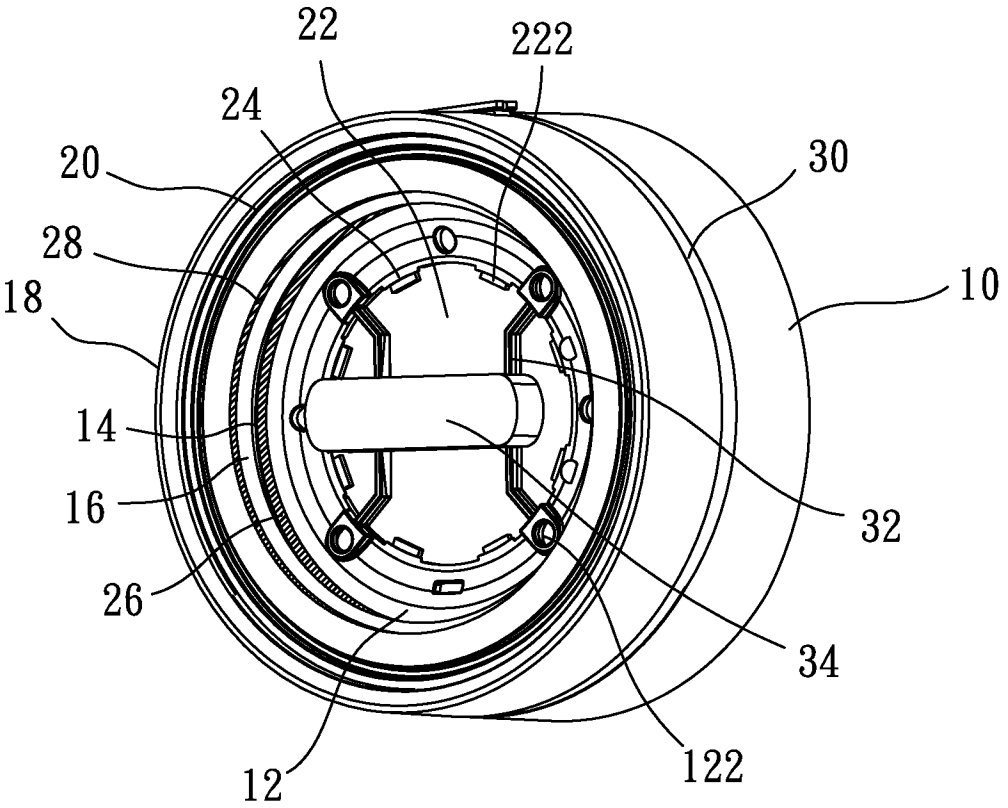
FIG. 6 is a perspective view of FIG. 5.

Refer to FIG. 5 and FIG. 6. FIG. 5 is an exploded view of an illumination device according to another embodiment of the present invention. FIG. 6 is a perspective view of FIG. 5. Since the structure design and light-guiding way of the bottom base 10, the light-guiding frame 12, the lower mirror 14, the light-guiding ring 16, the hollow cover 18 and the upper mirror 20 of the embodiment are identical to those of FIG. 1 and FIG. 2, the present invention only describes the difference and the identical features will not be reiterated. In addition to achieving the unique lighting effect for infinite mirroring, the other lighting functions for decorations are added whereby the entire product has industry practicability. For example, the lighting module 22 of the present invention is provided with a second lighting element 226. Preferably, the second lighting element 226 is arranged on a middle position of the lighting module 22. The first lighting elements 222 surround the second lighting element 226 with a lighting surface thereof emitting light upward. The light-guiding frame 12 is further provided with a light-guiding element 32 whose position corresponds to a position of the second lighting element 226. The light-guiding element 32 is preferably I-shaped and made of transparent material. The lower mirror 14 is provided with a transparent decoration element 34, and the lower mirror 14 has an opening 142 whose position corresponds to a position of the light-guiding element 32, and the opening 142 is provided with the transparent decoration element 34. When the lighting module 22 drives the second lighting element 226 to generate a second light source, the light-guiding element 32 guides the second light source of the second lighting element 226 to uniformly scatter to the transparent decoration element 34. Wherein, the light-guiding frame 12 further has a plurality of lockholes 122, and the light-guiding frame 12 is fixed on the bottom base 10 using a plurality of locking members (not shown) corresponding to the lockholes 122. As a result, when the lighting module 22 simultaneously drives the first lighting elements 222 and the second lighting element 226 to emit light, the lighting effect for infinite mirroring with gradient and endlessly-changing depth is achieved and the transparent decoration element 34 also produces the lighting effect. Certainly, the second lighting element 226 is realized with LEDs for different monochromatic lights or mixed lights, such that the entire illumination device produces the gorgeous lighting effect.

Figure 7:
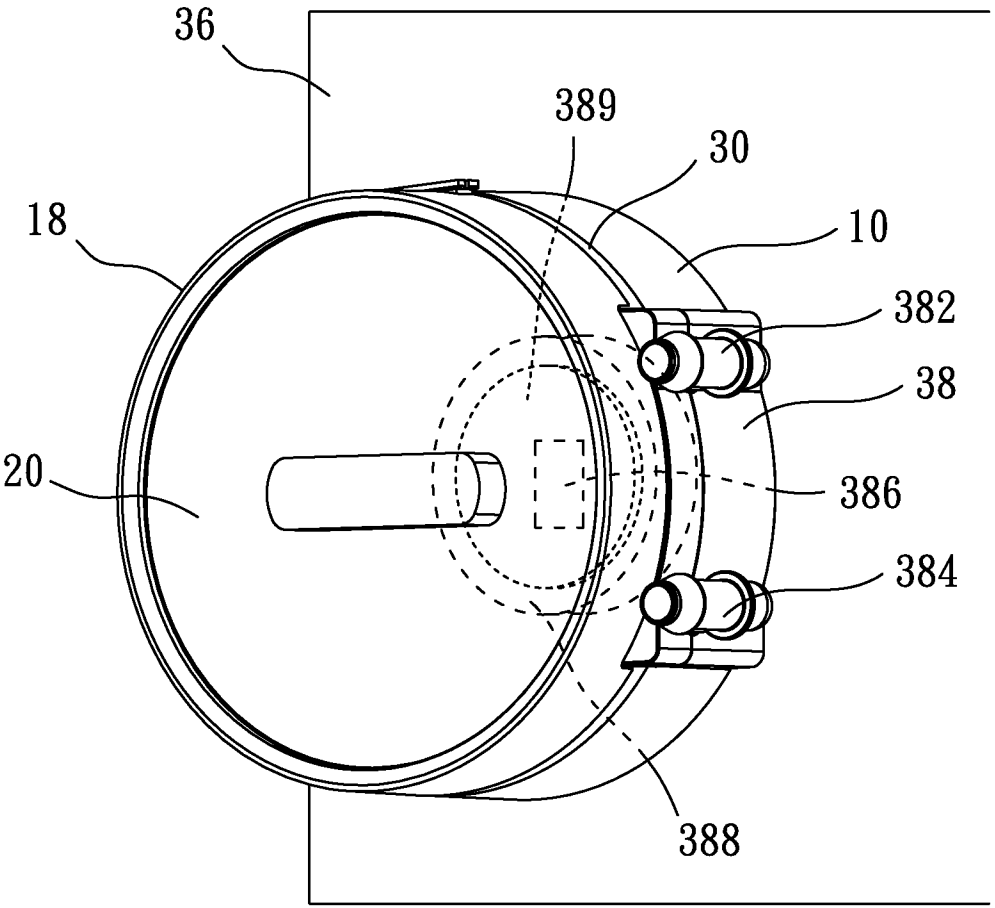
FIG. 7 is a diagram schematically showing an illumination device installed on an external electronic device according to an embodiment of the present invention.

Refer to FIG. 5 and FIG. 7 which is a diagram schematically showing the illumination device installed on an external electronic device according to an embodiment of the present invention. The illumination device is arranged on an external electronic device 36 electrically connected with the lighting module 22 of the bottom base 10. The external electronic device 36 is a computer or the other electronic device for illumination. The bottom base 10 is further provided with a water-cooling device 38 electrically connected with the external electronic device 36 and the lighting module 22 and dissipating a heat source of the external electronic device 36 to an exterior. The water-cooling device 38 further comprises an outlet water tube 382, an inlet water tube 384, a pump 386, an inner space 388 and a dissipation sink 389 in the inner space 388. The outlet water tube 382 and the inlet water tube 384 are arranged on an outer side of the bottom base 10. The pump 386, the inner space 388 and the dissipation sink 389 are arranged in the bottom base 10. The outlet water tube 382 and the inlet water tube 384 are connected with the inner space 388. When the external electronic device 36 operates, the lighting module 22 simultaneously drives the first lighting elements 222 and the second lighting element 226 to emit light and drives the water-cooling device 38 to operate. For example, the pump 386 transports cold water from the inlet water tube 384 to the inner space 388, uses the cold water to exchange heat with the dissipation sink 389, then expels the heated water from the outlet water tube 382, and dissipates a heat source of the external electronic device 36 to an exterior to achieve the dissipation effect.

In conclusion, the present invention guides light in two stages, uses the interruption elements to interrupt a part of the light, and uses the upper and lower mirrors to repeatedly reflect the light back and forth, thereby achieving the unique and dazzle lighting effect for infinite mirroring with gradient, endlessly-changing depth, practicability and visual beauty, and brings more business opportunities for industry.

Moreover, the present invention can further apply to any products so that the products have illumination functions to improve additional values. The illumination device with illumination and cooling functions of the present invention is installed on any external electronic device that requires dissipating heat, whereby the present invention finds application in more areas and possesses strong market competitiveness.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. An illumination device for infinite mirroring comprising:

a bottom base provided with a lighting module, and said lighting module has a plurality of first lighting elements spaced, and said first lighting elements generate a first light source;

a light-guiding frame arranged on said bottom base, and a lower end of said light-guiding frame has a plurality of light-guiding portions corresponding to said first lighting elements, and each said light-guiding portion has a light-received surface, and said light-guiding portions guide said first light source of said first lighting elements to pass through light-guiding scatter paths of said light-received surface, thereby forming a light-guiding light source;

a lower mirror arranged on said light-guiding frame and reflecting said light-guiding light source to form a reflection light source reflecting mirror images;

a light-guiding ring arranged on said lower mirror and having a light-guiding surface, and a lower end of said light-guiding ring has a first hollow interruption element, and said reflection light source incident on said light-guiding ring uniformly scatters to said light-guiding surface to form a ring-shaped light source, and said lower mirror uses said first hollow interruption element to interrupt a part of said reflection light source to form a spaced layered light source;

a hollow cover arranged on said bottom base and provided with a second hollow interruption element therein whereby said light-guiding frame, said lower mirror and said light-guiding ring are arranged between said bottom base and said hollow cover; and an upper mirror arranged on said hollow cover and simultaneously reflecting said ring-shaped light source and said spaced layered light source, and said second hollow interruption element interrupts said ring-shaped light source to form a multilayered mirroring light ring.

2. The illumination device for infinite mirroring according to claim 1, wherein said lighting module has said first lighting elements peripherally spaced, and said first lighting elements are light-emitting diodes for lateral lighting.

3. The illumination device for infinite mirroring according to claim 1, wherein said lighting module is further provided with a second lighting element, and said light-guiding frame is further provided with a light-guiding element whose position corresponds to a position of said second lighting element, and said lower mirror is provided with a transparent decoration element, and said light-guiding element guides a second light source of said second lighting element to uniformly scatter to said transparent decoration element.

4. The illumination device for infinite mirroring according to claim 3, wherein said lower mirror has an opening whose position corresponds to a position of said light-guiding element, and said opening is provided with said transparent decoration element.

5. The illumination device for infinite mirroring according to claim 1, further comprising an installation element, and said hollow cover is fixed on said bottom base through said installation element.

6. The illumination device for infinite mirroring according to claim 1, wherein said light-guiding frame further has a plurality of lockholes, and said light-guiding frame is fixed on said bottom base using a plurality of locking members corresponding to said lockholes.

7. The illumination device for infinite mirroring according to claim 1, wherein said upper mirror is fixed on said hollow cover through an adhesive.

8. The illumination device for infinite mirroring according to claim 1, wherein said light-guiding frame is a transparent light-guiding frame, and said light-guiding ring is a semi-transparent sand surface light-guiding ring.

9. The illumination device for infinite mirroring according to claim 1, wherein said illumination device is arranged on an external electronic device electrically connected with said lighting module of said bottom base.

10. The illumination device for infinite mirroring according to claim 9, wherein said bottom base is further provided with a water-cooling device electrically connected with said external electronic device and said lighting module and dissipating a heat source of said external electronic device to an exterior.

* * * * *